US005890951A

United States Patent [19]

Vu

[11] Patent Number: 5,890,951

[45] Date of Patent: Apr. 6, 1999

[54] UTILITY WAFER FOR CHEMICAL-MECHANICAL PLANARIZATION

[75] Inventor: Cuong van Vu, San Jose, Calif.

[73] Assignee: LSI Logic Corporation, Milpitas, Calif.

[21] Appl. No.: 632,550

[22] Filed: Apr. 15, 1996

[51] Int. Cl.[6] ..... B24B 53/007

[52] U.S. Cl. ..... 451/56; 451/444

[58] Field of Search ..... 451/443, 444, 451/21, 56, 72, 290, 291, 287, 286

[56] References Cited

U.S. PATENT DOCUMENTS

| | | | |
|---|---|---|---|
| 4,214,920 | 7/1980 | Amick et al. | 148/1.5 |
| 4,239,560 | 12/1980 | Chang et al. | 148/189 |
| 5,096,854 | 3/1992 | Saito et al. | 437/225 |
| 5,245,790 | 9/1993 | Jerbic | 51/121 |
| 5,259,888 | 11/1993 | McCoy | 134/2 |
| 5,403,228 | 4/1995 | Pasch | 451/259 |
| 5,456,627 | 10/1995 | Jackson et al. | 451/11 |

FOREIGN PATENT DOCUMENTS

| | | | |
|---|---|---|---|
| 7149158 | 9/1982 | Japan | 451/72 |
| 2-065967 | 3/1990 | Japan | 451/288 |

OTHER PUBLICATIONS

*Equipment Frontiers*, Quartzware Cleaning Technology; pp. 79 & 90; Solid State Technology Jan. 1988.

*Primary Examiner*—Robert A. Rose

[57] ABSTRACT

A utility wafer is used to mechanically condition and chemically stabilize a polishing pad and ready the pad for chemical-mechanical polishing of semiconductor production wafers. The utility wafer is fabricated from a high-purity ceramic material, such as quartz ($SiO_2$), or a high-purity metal, such as tungsten. Because there are no dielectric coatings to be maintained on the utility wafer, the utility wafer can be used much longer and at greatly reduced cost than other types of utility wafers. In one embodiment, a light reflective coating may be applied to one side of a ceramic utility wafer to ensure process machinery will detect the presence of the wafer. In another embodiment, a silicon wafer is bonded to the utility wafer to provide structural support to the utility wafer as the utility wafer is thinned by the abrasive action of the polishing pad.

6 Claims, 2 Drawing Sheets

UTILITY WAFER FOR CHEMICAL-MECHANICAL PLANARIZATION

TECHNICAL FIELD

The present invention relates to chemical-mechanical polishing of semiconductor devices, and more particularly to the use of utility wafers for conditioning and dressing polishing pads that are used during chemical-mechanical polishing of semiconductor devices.

BACKGROUND

The fabrication of integrated circuitry on a semiconductor substrate involves many intricate and complex processes. One such process, known as chemical-mechanical polishing (CMP), is used to mechanically and chemically planarize the devices that are formed on the semiconductor substrate. Materials deposited onto the substrate are often concentrated at particular points along the surface of the substrate, producing what are commonly referred to as peaks and valleys in the deposited materials. Chemical-mechanical polishing is typically performed at various stages of fabrication to smooth out these peaks and valleys and planarize each layer of depositions to some desired degree before the fabricated devices are eventually diced and separated one from another.

Chemical-mechanical polishing is described in U.S. Pat. No. 5,245,790 to Jerbic, the entire contents of which is expressly incorporated herein by reference. During Chemical-mechanical polishing (CMP), a polishing pad is brought into abrasive contact with a product wafer. An abrasive slurry, which is usually comprised of a ceramic material such as silicon dioxide or alumina, is applied to the pad as the pad and product wafer are moved relative to one another. The slurry acts upon the wafer to chemically etch and mechanically wear the devices. The abrasive action between the pad and wafer uniformly removes the superfluous material to create a more planar surface for the next deposition of material.

Occasionally, material that is removed from the production wafers will accumulate on the pad and reduce the pad's ability to properly erode the wafer. Great care must be taken during CMP to ensure that the devices are properly eroded, so when clogging occurs, the pad must be removed from production and reconditioned. Clogged pads are typically reconditioned, or cleaned by drawing a rough implement across the pad surface to remove the excess material and contaminants from the pad.

To minimize the potential for damage to product wafers during CMP, new and reconditioned pads are operated for a period of time with the use of a utility wafer, sometimes referred to in the art as a "dummy" wafer. Utility wafers emulate production wafers and act to stimulate, smooth and condition the pad before the pad is applied to a production wafer. The utility wafer also functions to alert process personnel of any deficiencies in pad performance. If a pad fails to erode the utility wafer with uniformity and consistency, or if the pad introduces impurities into the utility wafer, process personnel can determine that the pad is need of reconditioning or possible disposal.

Prior art utility wafers are comprised of a silicon wafer having a thin coating of a dielectric material, such as silicon dioxide, on the working surface of the wafer. The dielectric coating is relatively thin, typically about 10,000 angstroms in thickness. Due to the abrasive action between the pad and utility wafer, the silicon dioxide coating wears quickly so that the coated wafer can be used only once for a relatively short period of time. The silicon utility wafer can be re-used, but only after it has been etched and stripped of the old coating and re-deposited with a new coating of material. Maintenance of such prior art utility wafers is therefore expensive and lowers productivity by occupying equipment that would otherwise be utilized for other necessary processes, such as manufacturing production wafers.

What is needed, therefore, is a low-cost, low-maintenance utility wafer that closely emulates production wafers for the purpose of conditioning a CMP polishing pad. An object of the present invention is to provide such a wafer.

SUMMARY

The present invention provides a utility wafer for use in a polishing machine to condition a wafer polishing pad that is used to polish product wafers during production. The utility wafer, sometimes referred to as a "dummy" wafer, includes a high purity solid ceramic or metal member having mechanical and chemical polishing and erosion properties that are substantially the same as those of the product wafer. The utility wafer, having a planar configuration, includes a first surface formed on the wafer and configured for engaging and being engaged, eroded, and polished by the polishing pad. A second surface is formed on the utility wafer in an opposed relationship with the first surface and is configured for supporting the ceramic or metal member for movement relative to the polishing pad in the polishing machine.

The high purity member may be fabricated from a variety of materials. In one embodiment, a high purity ceramic material is used. The ceramic material may be selected from the group consisting of silicon dioxide, alumina, tungsten carbide, and titanium nitride. In another embodiment, the member is constructed of a high purity metal, which may be selected from the group consisting of tungsten, copper, and aluminum.

To provide additional structural support for the high purity member, a structurally supportive substrate may be attached to the second surface of the member.

In accordance with a more particular aspect of the invention, one embodiment provides a holder mechanically connected to the second surface to move the wafer relative to, and apply the wafer to, the polishing pad.

The invention also provides a method of conditioning a polishing pad. The method includes the step of providing a high purity wafer selected from the group consisting of silicon dioxide, alumina, tungsten carbide, titanium nitride, tungsten, copper, and aluminum. An abrasive slurry is applied to the pad, the wafer is brought into contact with the pad, and the wafer and pad are moved in relation to each other to condition the pad.

BRIEF DESCRIPTION OF PREFERRED EMBODIMENTS

The preferred embodiments of the invention will now be described in further detail with reference to the drawings wherein like reference characters designate like or similar elements throughout the several drawings as follows.

DETAILED DESCRIPTION OF PREFERRED EMBODIMENTS

Figure 1:
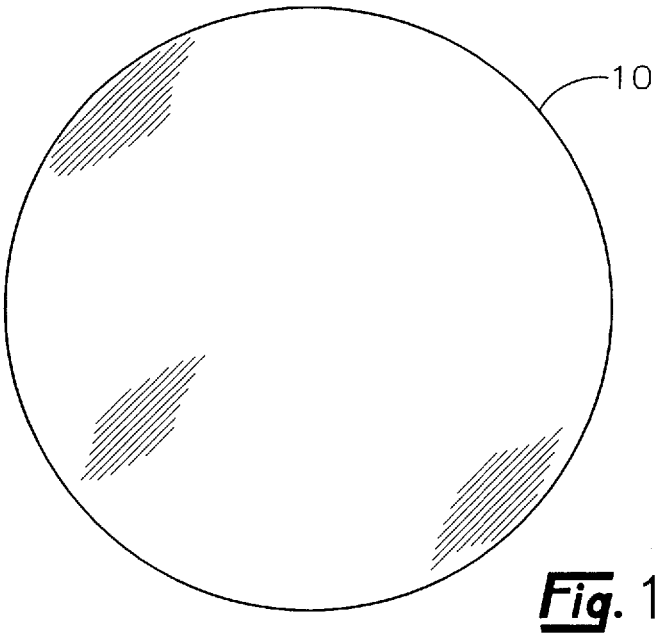
FIG. 1 is a plan view of a utility wafer of the present invention.
Figure 2:
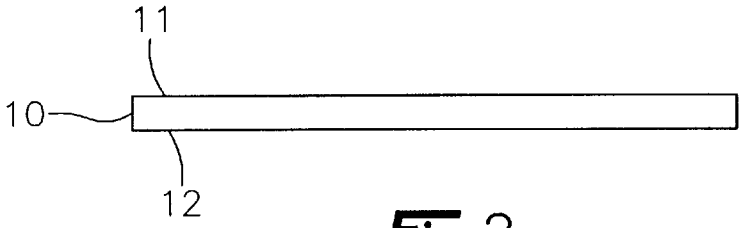
FIG. 2 is a side view of the utility wafer.

According to the present invention, there is provided a utility wafer for mechanically conditioning and chemically stabilizing a polishing pad used for polishing/planarizing a semiconductor wafer at various stages of manufacture of the semiconductor wafer. As FIGS. 1 and 2 illustrate, the utility wafer 10 is preferably a wafer having thin, flat, circular dimensions, such as an eight inch diameter wafer 10 with a thickness of 50 mils. Other preferred dimensions of the utility wafer 10 include wafers having four and six inch diameters with a thickness varying from three to one hundred fifty mils. In a preferred embodiment of the present invention, a high-purity ceramic material is used as a utility wafer during mechanical conditioning of CMP pads. Such high-purity ceramic materials include but are not limited to quartz (silicon dioxide $SiO_2$), alumina ($Al_2O_3$), tungsten carbide (WC), and titanium nitride ($TiN_2$). In another preferred embodiment, the utility wafer 10 is made of a high-purity metal, such as tungsten, copper, or aluminum, for chemically stabilizing a chemical slurry deposited on the pad. By "high-purity", what is meant is that the utility wafer 10 should be of sufficient purity to condition a polishing pad 20 without contaminating the pad 20, either chemically or mechanically, beyond the level of chemical or mechanical contamination to be caused by the slurry 25. In other words, it is preferred that the utility wafer 10 contaminate the polishing pad 20 to a lesser degree than does the polishing slurry 25.

The preferred purity level of the utility wafer 10 will depend upon the polishing process. For applications that require exacting control of the polishing process, the utility wafer 10 should be at least 99.99% pure. The wafer 10 may be of less purity for applications requiring less stringent control of possible contaminants. Such high-purity ceramic wafers can be fabricated by controlled growth of an ingot from solution. The ceramic utility wafer 10 is then sliced to a desired thickness from the ingot. It will be understood, however, that any suitable method of manufacturing ceramic wafers of suitable purity is acceptable.

Figure 4:
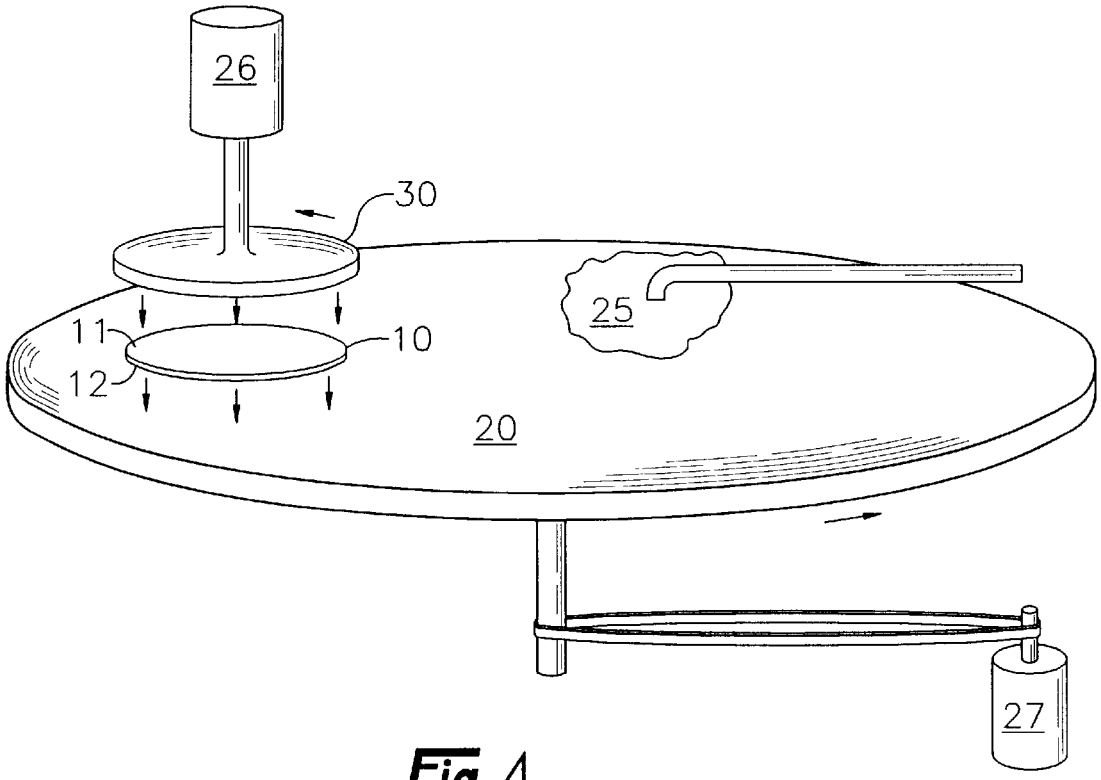
FIG. 4 is an isometric view of process machinery showing relative positions of the utility wafer and CMP polishing pad.

As illustrated in FIG. 4, during mechanical conditioning and chemical stabilization of a CMP polishing pad 20 a utility wafer 10 is moved into contact with the surface of the pad 20. To mechanically condition the pad 20 for planarization of ceramic depositions, a utility wafer 10 made of a high-purity ceramic material is employed. A wafer 10 made of a high-purity metal is employed to chemically stabilize the polishing slurry 25. The abrasive slurry 25 is continuously fed to the pad 20 as the pad 20 and wafer 10 are each rotated and moved relative to one another by process machinery motors 26 and 27.

When a ceramic utility wafer 10 is used, the pad 20 polishes the wafer 10 while the wafer 10 functions to primarily condition the pad 20 for CMP polishing by removing unneeded material from the pad 20, evenly distributing the slurry 25, and planarizing the pad 20. In this manner, the pad 20 is mechanically conditioned before it is used to planarize ceramic depositions on the production wafer, thus preventing damage to the production wafer that might otherwise be incurred.

When a metal utility wafer 10 is used, the metal wafer 10 primarily acts to chemically stabilize the slurry 25 that has been distributed on the pad 20. When planarizing metal layer depositions on production wafers, chemical elements within the slurry 25 will initially tend to improperly erode the metal depositions. The metal depositions will eventually react with and stabilize the slurry chemicals, but not before one or more production wafers have been damaged. To prevent such loss of production wafers, the metal utility wafer 10 stabilizes the chemicals in the slurry 25 before the pad 20 is used to planarize the metal layers of the production wafers.

Figure 5:
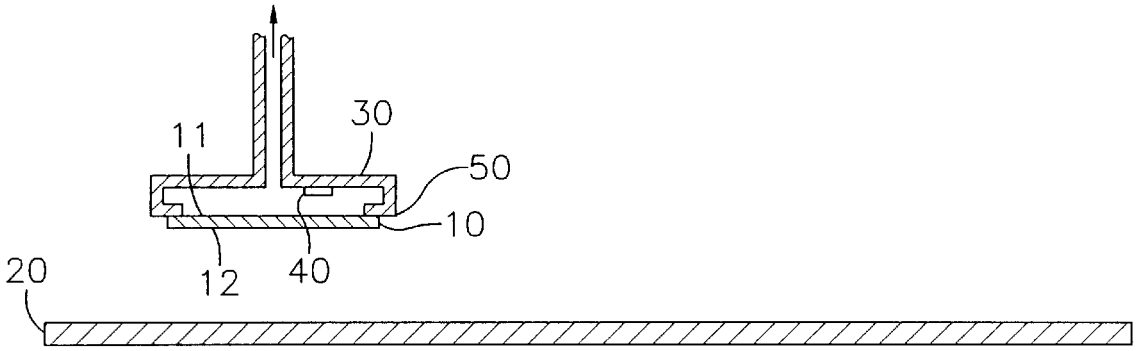
FIG. 5 is a cross-sectional view of a utility wafer being held by the process machinery of FIG. 4 in a position above the CMP polishing pad.

With continuing reference to FIG. 4, the utility wafer 10 is typically lowered to the surface of the rotating pad 20 by use of a holding implement, or holder 30. Although the mechanization of process machinery varies greatly, the holder 30 shown in FIG. 4 secures or holds the wafer 10 by means of a vacuum applied to the back (non-working side) 11 of the wafer 10. Vacuum pressure generated by process machinery is transferred through the holder 30 to the utility wafer 10, drawing the wafer 10 against the holder 30 to form a vacuum seal 50, as shown in FIG. 5, between the holder 30 and wafer 10. Process machinery varies as to the maximum wafer weight that can be accommodated by the holder 30, so initial wafer thickness (the distance between the working side 12 and the back side 11 prior to erosion of the wafer 10) will vary accordingly. For some machines, the maximum initial thickness of the wafer will be about between 40 to 50 mils. However, other process machines capable of handling thicker, heavier wafers are known to exist. Since thicker wafers generally last longer and enable more pads 20 to be conditioned by the same wafer 10, a preferred embodiment employs a wafer 10 having the maximum thickness that can be accommodated by available process machinery.

Methods employed by process machinery to detect the presence of the utility wafer 10 also vary greatly. For the machinery of FIG. 4, vacuum detection may be employed (i.e., the presence of a vacuum indicates the presence of the utility wafer 10). Machine operation is halted when there is no wafer 10 being retained by the holder 30. Some machines employ a light-reflective type sensor 40 to detect the presence of a wafer 10 by detecting light that is reflected off the back surface 11 of the wafer 10. A light emitting diode within the sensor 40 provides a source of light that is directed onto the back surface 11 of the wafer 10. Light is reflected off the back surface 11 and onto a detecting element within the sensor 40, thereby indicating the presence of the wafer 10. Other process machines employ a capacitance type proximity sensor (not shown) which senses the presence of the wafer 10 by detecting capacitance changes that occur within the sensor when a wafer 10 is attached to the holder 30.

Quartz, being a relatively transparent material, is often difficult to detect by a light reflective proximity sensor 40. Erosion caused by the abrasive action of the CMP pad can also increase the transparency of the quartz wafer 10 to such an extent that machines which employ a light reflective type proximity sensor 40 are unable to detect the presence of the wafer 10. To ensure that the quartz wafer 10 has sufficient reflectivity to enable proper operation of machines employing a light reflective proximity sensor 40, the back side 11 of the wafer 10 may be coated with a light reflective material such as aluminum or titanium nitride. The reflective coating need only be applied once during initial fabrication of the wafer 10. For process machinery that does not use the reflection method to detect the presence of the wafer 10, the reflective coating is not necessary.

Figure 6:
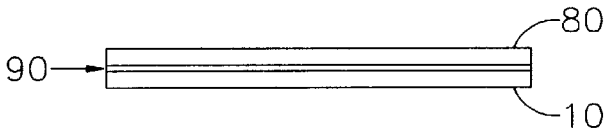
FIG. 6 is a side view of a utility wafer attached to a silicon wafer with a layer of adhesive to provide structural support to the utility wafer.

As is known, quartz is a relatively brittle material and over time, the pad 20 erodes the wafer 10 to the point where the wafer 10 becomes too thin to withstand the mechanical forces that are exerted on it during pad conditioning. The brittleness of quartz also limits the minimum thickness to which a quartz wafer may be practicably manufactured. Other ceramic materials also exhibit brittle characteristics. To add structural rigidity and support to the ceramic wafer 10, an embodiment of the invention provides for attachment of a ceramic utility wafer 10 to a structurally supportive substrate, such as the silicon wafer 80 shown in FIG. 6. A thin layer of adhesive 90 is used to bond the ceramic wafer 10 to the silicon wafer 80. The silicon wafer 80 provides the necessary structural support to prevent the ceramic wafer 10 from breaking due to erosion of the brittle ceramic material. The silicon wafer 80 also eliminates the need for a reflective coating on the back side 11 of the wafer 10 since the silicon wafer 80 provides sufficient light reflectivity to enable machines employing a light reflective proximity sensor 40 to function properly.

In another preferred embodiment of the present invention, the utility wafer 10 shown in FIGS. 1–6 is a high-purity alumina ($Al_2O_3$) wafer 10. Similar to quartz wafer fabrication, alumina wafers may be fabricated by controlled growth of an alumina ingot from solution. The wafer is then sliced from the alumina ingot to a desired thickness. However, it will be understood that any suitable method of manufacturing alumina wafers of suitable purity is acceptable.

Semiconductor device fabrication often employs the deposition of metals, such as tungsten, copper, and aluminum, onto the production wafer. Therefore, during chemical mechanical polishing of the production wafer, such metals are often among the materials being removed from the production wafer during polishing. Metal utility wafers 10 made from high-purity tungsten, copper, or aluminum may be used to stabilize chemicals on the pad 20. Such metal wafers 10 have been shown to closely emulate the erosion characteristics of production wafers while providing excellent slurry distribution and stabilization functions. Unlike some of the ceramic wafers previously described, no reflective coating need be applied to these metal wafers. The unaugmented metal wafers possess sufficient light reflectivity for process machinery employing light reflective wafer detection means.

The alumina wafer 10, like all embodiments of the present invention, requires no dielectric coating and can be used many more times at much less expense than prior art utility wafers. Like the quartz wafer embodiment previously described, alumina wafers may require a reflective coating, depending on the particular method of wafer detection employed by the process machinery. After extended use and erosion, the alumina wafer 10 can also become thin and weak and therefore susceptible to breakage under mechanical forces applied by the pad 20 and holder 30. To extend its useful life, the alumina wafer 10 (as well as all embodiments of the present invention) may be bonded to a silicon wafer 80 or other structurally supportive substrate as previously described with reference to FIG. 6.

Figure 3:
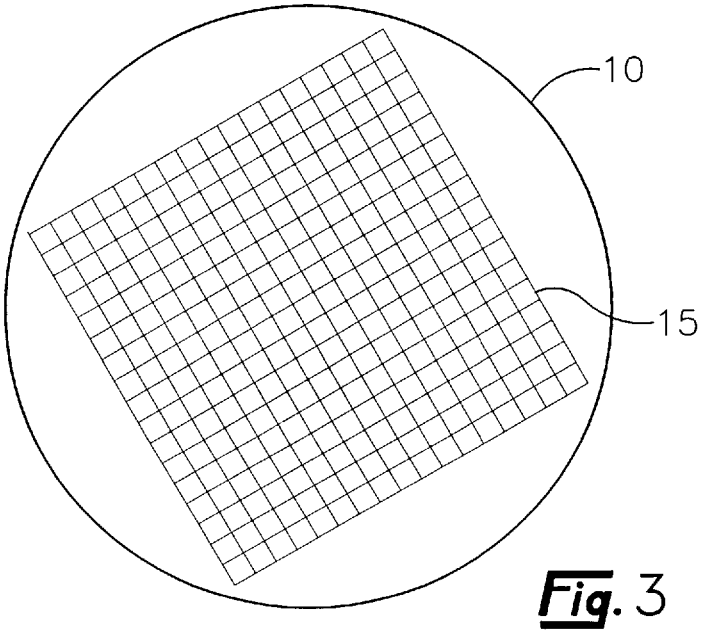
FIG. 3 is a plan view of the utility wafer with a pattern etched into the working surface of the wafer.

When used for conditioning CMP polishing pads, the utility wafer 10 of the present invention closely resembles or emulates the response of an actual silicon production wafer during CMP. In other words, the utility wafer 10 exhibits erosion and other planarization characteristics that are similar to those exhibited by a silicon production wafer when the newly deposited layers of the production wafer are polished by the CMP pad 20. The working surface 12 of the utility wafer 10 may include a raised pattern or scoring 15, as illustrated in FIG. 3, to improve the scrubbing, or conditioning action on the pad 20. For example, the working surface 12 may be etched to form a series of raised, perpendicularly intersecting grid lines 15, or the raised pattern may include a series of only parallel raised lines.

As previously stated, the utility wafer 10 of the present invention requires no dielectric coating. Since there are no requirements for maintenance of a dielectric coating (e.g., it does not need to be etched, stripped, or re-deposited with a dielectric coating in order to be re-used), the utility wafer 10 can be used many more times for much longer periods of time and at much lower cost than prior art utility wafers that are coated with a dielectric material. Utilization time of processing equipment is also improved since the equipment is not needed to apply and maintain the dielectric coatings.

It is contemplated, and will be apparent to those skilled in the art from the foregoing specification, drawings, and examples that modifications and/or changes may be made in the embodiments of the invention. Accordingly, it is expressly intended that the foregoing are illustrative of preferred embodiments only, not limiting thereto, and that the true spirit and scope of the present invention be determined by reference to the appended claims.

What is claimed is:

1. A method of mechanically conditioning a polishing pad for polishing a production wafer, the polishing pad of the type which has a polishing surface that is cleaned by drawing a rough implement across it, the polishing surface rotating within a first plane and about a first rotational axis, the method comprising the steps of:

disengaging the polishing surface of the polishing pad from the production wafer;

drawing the rough implement across the polishing surface of the polishing pad to remove contaminants from the polishing surface of the polishing pad;

providing an uncoated high-purity ceramic wafer having a conditioning surface rotating within a second plane and about a second rotational axis, the ceramic selected from the group consisting of silicon dioxide, alumina, tungsten carbide, and titanium nitride;

positioning the first rotational axis and the second rotational axis so that the first rotational axis and the second rotational axis are parallel but not aligned;

positioning the conditioning surface of the high-purity wafer and the polishing surface of the polishing pad so that the first plane and the second plane are within a common plane;

applying an abrasive slurry between the conditioning surface of the high-purity wafer and the polishing surface of the polishing pad;

distributing the slurry evenly over the polishing surface of the polishing pad by moving the high-purity wafer and the polishing pad in relation to each other within the common plane; and conditioning the polishing surface of the polishing pad by moving the high-purity wafer and polishing pad in relation to each other within the common plane.

2. A method of mechanically conditioning a polishing pad for polishing a production wafer, the conditioning occurring at a time when the polishing pad is not polishing the production wafer, the polishing surface rotating within a first plane and about a first rotational axis, the method comprising the steps of:

providing an uncoated high-purity ceramic wafer having a conditioning surface rotating within a second plane and about a second rotational axis, the ceramic selected from the group consisting of silicon dioxide, alumina, tungsten carbide, and titanium nitride;

positioning the first rotational axis and the second rotational axis so that the first rotational axis and the second rotational axis are parallel but not aligned;

positioning the conditioning surface of the high-purity wafer and the polishing surface of the polishing pad so that the first plane and the second plane are within a common plane;

applying an abrasive slurry between the conditioning surface of the high-purity wafer and the polishing surface of the polishing pad;

distributing the slurry evenly over the polishing surface of the polishing pad by moving the high-purity wafer and the polishing pad in relation to each other within the common plane; and conditioning the polishing surface of the polishing pad by moving the high-purity wafer and polishing pad in relation to each other within the common plane.

3. A method of chemically conditioning a polishing pad for polishing a production wafer, the polishing pad of the type which has a polishing surface that is cleaned by drawing a rough implement across it, the polishing surface rotating within a first plane and about a first rotational axis, the method comprising the steps of:

disengaging the polishing surface of the polishing pad from the production wafer;

drawing the rough implement across the polishing surface of the polishing pad to remove contaminants from the polishing surface of the polishing pad;

providing an uncoated high-purity metal wafer having a conditioning surface rotating within a second plane and about a second rotational axis, the metal selected from the group consisting of tungsten, copper, and aluminum;

positioning the first rotational axis and the second rotational axis so that the first rotational axis and the second rotational axis are parallel but not aligned;

positioning the conditioning surface of the high-purity wafer and the polishing surface of the polishing pad so that the first plane and the second plane are within a common plane;

applying an abrasive slurry between the conditioning surface of the high-purity wafer and the polishing surface of the polishing pad;

distributing the slurry evenly over the polishing surface of the polishing pad by moving the high-purity wafer and the polishing pad in relation to each other within the common plane; and chemically stabilizing the slurry by contact with the conditioning surface of the high-purity wafer.

4. A method of chemically conditioning a polishing pad for polishing a production wafer, the conditioning occurring at a time when the polishing pad is not polishing the production wafer, the polishing surface rotating within a first plane and about a first rotational axis, the method comprising the steps of:

disengaging the polishing surface of the polishing pad from the production wafer;

providing an uncoated high-purity metal wafer having a conditioning surface rotating within a second plane and about a second rotational axis, the metal selected from the group consisting of tungsten, copper, and aluminum;

positioning the first rotational axis and the second rotational axis so that the first rotational axis and the second rotational axis are parallel but not aligned;

positioning the conditioning surface of the high-purity wafer and the polishing surface of the polishing pad so that the first plane and the second plane are within a common plane;

applying an abrasive slurry between the conditioning surface of the high-purity wafer and the polishing surface of the polishing pad;

distributing the slurry evenly over the polishing surface of the polishing pad by moving the high-purity wafer and the polishing pad in relation to each other within the common plane; and chemically stabilizing the slurry by contact with the conditioning surface of the high-purity wafer.

5. A method of manufacturing a semiconductor device comprising the steps of:

conditioning a polishing pad according to the method of claim 2; and polishing at least one layer of the semiconductor device with the polishing pad.

6. A method of manufacturing a semiconductor device comprising the steps of:

conditioning a polishing pad according to the method of claim 4; and polishing at least one layer of the semiconductor device with the polishing pad.

* * * * *